United States Patent [19]

Perr et al.

[11] Patent Number: 4,463,901

[45] Date of Patent: Aug. 7, 1984

[54] UNIT FUEL INJECTOR HAVING INDEPENDENTLY CONTROLLED TIMING AND METERING

[75] Inventors: Julius P. Perr; Lester L. Peters, both of Columbus, Ind.

[73] Assignee: Cummins Engine Company, Inc., Columbus, Ind.

[21] Appl. No.: 403,066

[22] Filed: Jul. 29, 1982

[51] Int. Cl.[3] ..... F02M 45/00

[52] U.S. Cl. ..... 239/95; 239/124; 417/385

[58] Field of Search ..... 239/88–95; 123/502; 417/383, 385, 386, 387; 239/124, 125, 533.2, 533.12, 584

[56] References Cited

U.S. PATENT DOCUMENTS

| | | | |
|---|---|---|---|
| 2,997,994 | 8/1961 | Falberg | 123/502 |
| 4,402,456 | 9/1983 | Schneider | 239/90 |
| 4,410,137 | 10/1983 | Perr | 239/95 |
| 4,410,138 | 10/1983 | Peters et al. | 239/95 |
| 4,420,116 | 12/1983 | Warlick | 239/95 |

FOREIGN PATENT DOCUMENTS

| | | | |
|---|---|---|---|
| 57-2458 | 1/1982 | Japan | 239/91 |

*Primary Examiner*—John J. Love
*Assistant Examiner*—Michael J. Forman
*Attorney, Agent, or Firm*—Sixbey, Friedman & Leedom

[57] ABSTRACT

A unit fuel injector assembly (2, 88) is disclosed for periodically injecting fuel of a variable quantity on a cycle to cycle basis as a function of the pressure of fuel supplied to the injector from a source of fuel (48) and at a variable time during each cycle as a function of the pressure of a timing fluid supplied to the injector from a source of timing fluid (54). A reciprocating plunger assembly (24,146) is received within the injector body (10, 106) and includes an upper plunger section (26, 148), a lower plunger section (28,150) and an intermediate plunger section (30,152) in order to define a variable volume timing chamber (32,138), a variable volume injection chamber (34,162) and a variable volume compensation chamber (36,176). Biasing means (38) including upper compression spring (40,180) and lower compression spring (42, 182) are arranged in the compensation chamber (36,176) to independently bias the lower plunger section (28,150) and the intermediate plunger section (30,152) in opposite directions to tend to collapse the timing chamber (32,138) and injection chamber (34,162). A plurality of passages (58,158,188,194) are provided to cause both the timing chambers (32,138) and the injection chamber (162) to be spilled near the end of each injection event to produce a sharper end of injection and compensation for wear in the cam-operated, actuating mechanism (4).

14 Claims, 10 Drawing Figures

FIG. 6.
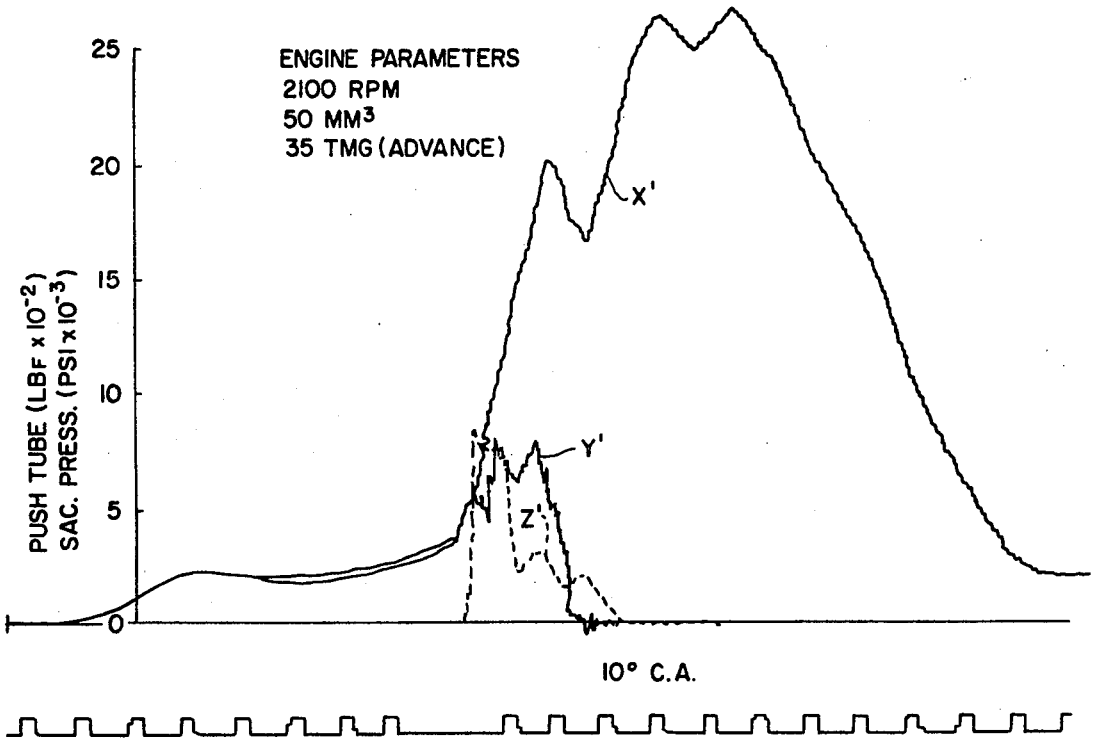
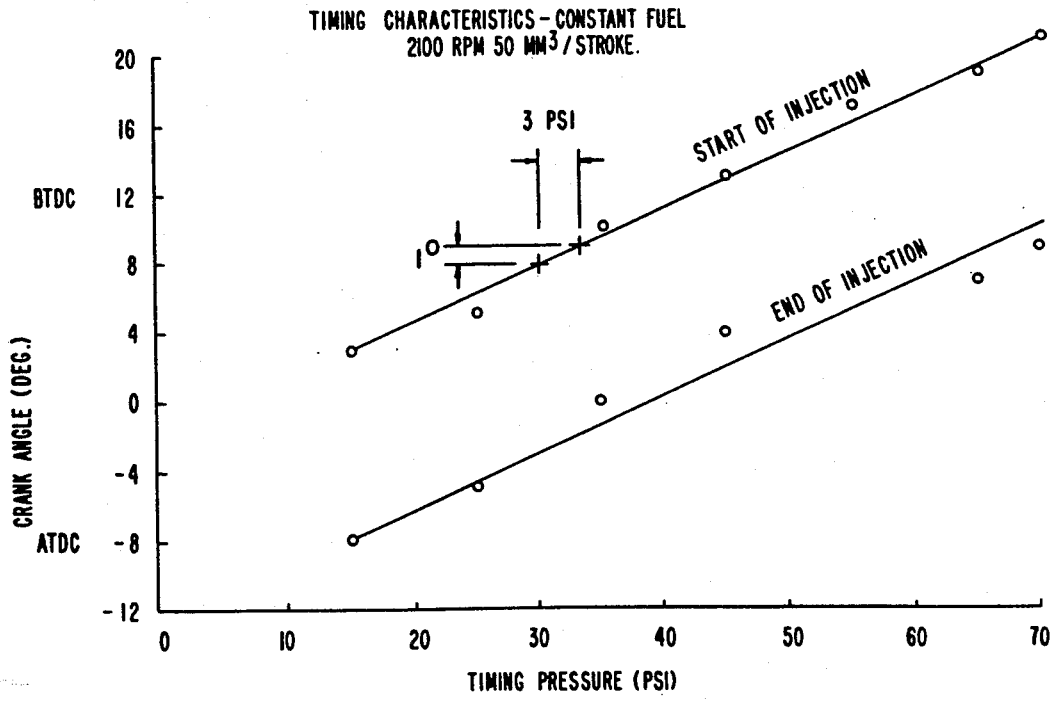
FIG. 7

UNIT FUEL INJECTOR HAVING INDEPENDENTLY CONTROLLED TIMING AND METERING

DESCRIPTION

1. Technical Field

This invention relates to a periodic fuel injector designed to inject fuel pulses of variable quantity and timing into the cylinder of an internal combustion engine.

2. Background Art

The design of a commercially competitive fuel injector normally involves acceptance of some characteristics which are less than optimal since the basic goals of low cost, high performance and reliability are often in direct conflict. For example, cam operated unit injectors, such as disclosed in U.S. Pat. No. 3,544,008, are more expensive to construct but are more reliable and accurate than are distributor-type fuel injector systems having a single centralized high pressure pump and a distributor valve for metering and timing fuel flow from the pump to each of a plurality of injection nozzles as disclosed in U.S. Pat. No. 3,557,765.

As the need for higher engine efficiency and pollution abatement have increased, it has become increasingly evident that some economical means must be provided to vary injector timing in response to changing engine operation conditions. Such control is relatively straight forward in distributor-type fuel injector systems since the injection event is controlled at one central location. However, in unit injector systems, control over injector timing ordinarily requires modification of each individual unit injector, thereby adding significantly to the overall cost of the system.

U.S. Pat. Nos. 2,997,994 and 2,863,438 provide examples of attempts to solve this dilemma by disclosing a fairly simple mechanism for achieving variable timing in unit injectors. In particular, these patents disclose the use of a collapsible hydraulic link to selectively change the effective length of the cam operated fuel injector plunger. However, the simplicity of these hydraulic timing controls is only achieved by operating the hydraulic link in either a fully expanded or fully collapsed mode. Thus there can only be a stepped change in timing of the injection event which will not necessarily suit the broad range of conditions normally encountered during the operation of an engine. Attempts to provide for infinite variations in injection timing, even when a hydraulic link is employed, have generally involved the use of a mechanical rack which controls the size and/or the point of collapse of the hydraulic link. Examples of such hydraulic/mechanical systems are disclosed in U.S. Pat. Nos. 3,847,510 and 4,092,964.

Examples of techniques for providing infinite variation of unit injector timing by other means are illustrated in U.S. Pat. Nos. 3,035,523 and 3,083,912 wherein fairly complex hydraulic arrangements for this purpose are disclosed. However, in these systems the quantity injected and the change in timing are interrelated and may not be controlled independently of one another.

Independent control of fuel injection timing and quantity is critical to the achievement of highly efficient, non-polluting operation of a fuel injected internal combustion engine. However, such control must not sacrifice reliability and economy. U.S. Pat. Nos. 4,249,499 and 3,951,117 disclose fuel injectors which attempt to achieve independent control over injection timing and quantity. Each of these patents disclose examples of pressure/time unit injectors which respond to a hydraulic variable pressure signal to control injector timing. While useful for the purposes intended, the injectors disclosed in U.S. Pat. Nos. 4,249,499 and 3,951,117 do not entirely separate the timing and fuel metering functions or are too complex to achieve the desired level of low cost and reliability. For example, in U.S. Pat. No. 3,951,117 the variable timing chamber and variable metering chamber of the disclosed injector are separated only by a fixed length shuttle piston whose movement in response to change in the volume of one chamber may cause an immediate effect in the volume and/or pressure of fluid in the other chamber. The system disclosed in U.S. Pat. No. 4,249,499 discloses an infinitely variable timing system but achieves this result by provision of a fairly complex structure including a timing chamber, a pair of spring biased piston elements and external fittings located outside of the conventional injector body. Such a system could add significantly to the cost of a commercial injector.

Other types of injectors employing a hydraulic link which may effect injector timing have been disclosed such as in Danish Pat. No. 56,902 issued Nov. 6, 1939 and U.S. Pat. Nos. 3,029,737 and 3,782,864. However, these additional disclosures do not teach how to control completely independently both the quantity and timing of fuel injection.

In short, the prior art fails to disclose a low cost, highly reliable fuel injector which provides sufficiently independent control over the timing and metering of fuel pulses.

SUMMARY OF THE INVENTION

The basic object of this invention is to overcome the deficiencies of the prior art by providing a fuel injector for periodically injecting fuel pulses of a variable quantity on a cycle to cycle basis as a function of the pressure of fuel supplied to the injector and at a variable time as a function of pressure of a timing fluid supplied to the injector wherein the quantity of fuel injected and the timing of each injection are controlled totally independently of one another.

Another more specific object of this invention is to provide a fuel injector including an injector body containing a central bore in which is mounted a lower plunger section, an upper plunger section and an intermediate plunger section between the upper and lower sections to define separate timing and injection chambers. Biasing means are mounted within the injector body for biasing the lower and intermediate plunger sections in directions which tend to collapse the respective timing and injection chambers wherein the force applied to the lower plunger section is independent of the position of the intermediate plunger section and the force applied to the intermediate plunger section is independent of the position of the lower plunger section.

Still a further object of the subject invention is to provide an injector body containing a timing fluid supply passage and a timing fluid drain passage, wherein the passages are positioned to cause timing fluid to pass into the timing chamber only when the upper plunger section is adjacent its uppermost position within the injector body to cause timing fluid to be discharged from the timing chamber only when the upper plunger section is adjacent its lowermost position within the injector body.

Another object of the subject invention is to provide an injector body containing the passages as described above in combination further with a fuel drain passage positioned to cause fuel in the injection chamber to be spilled to a fluid drain only when the lower plunger section is adjacent but not yet at its lowermost position within the injector body and to cause the fuel drain passage to be closed when the lower plunger section reaches its lowermost position.

A still more specific object of the subject invention is to provide biasing means for an injector of the type described above including an upper compression spring, a lower compression spring and a retainer means for holding one end of each compression spring in a fixed axial position and for causing the other end of each compression spring to engage the intermediate plunger section and lower plunger section, respectively, to bias independently the intermediate and lower plunger sections in opposite directions.

A still more specific object of the subject invention is to provide a fuel injector for periodically injecting fuel pulses of a variable quantity on a cycle to cycle basis as a function of the pressure of fuel supplied to the injector from a source of fuel and at a variable time during each cycle as a function of the pressure of timing fluid supplied to the injector from a source of timing fluid including an injector body containing a central bore and an injection orifice at the lower end of the body and a reciprocating plunger assembly including an upper plunger section, an intermediate plunger section and a lower plunger section serially mounted within the central bore to define a variable volume injection chamber located between the lower plunger section and the lower end of the injector body containing the injection orifice. The variable volume injection chamber communicates during a portion of each injector cycle with the source of fuel. A variable volume timing chamber is located between the upper and intermediate plunger sections, and the timing chamber communicates for a portion of each injector cycle with the source of timing fluid. Between the intermediate and lower plunger sections is a variable volume compensation chamber in which is mounted a biasing means for biasing the intermediate and lower plunger sections in opposite directions to collapse the timing and injection chambers, respectively, while tending to expand the compensation chamber.

Still other and more specific objects of the invention will be apparent from a consideration of the following brief description of the drawings and description of the preferred embodiment.

BRIEF DESCRIPTION OF THE DRAWINGS

FIG. 6 is a graph showing the push tube load and the sac pressure of an injector system designed in accordance with the subject invention compared with a more conventional injection system wherein the engine is operating under different conditions from those illustrated in FIG. 5.

FIG. 7 is a graph of the variation in the start and end of injection for both advanced and retarded operation of the injector plotted against engine speed.

BEST MODE FOR CARRYING OUT THE INVENTION

Figure 1A:
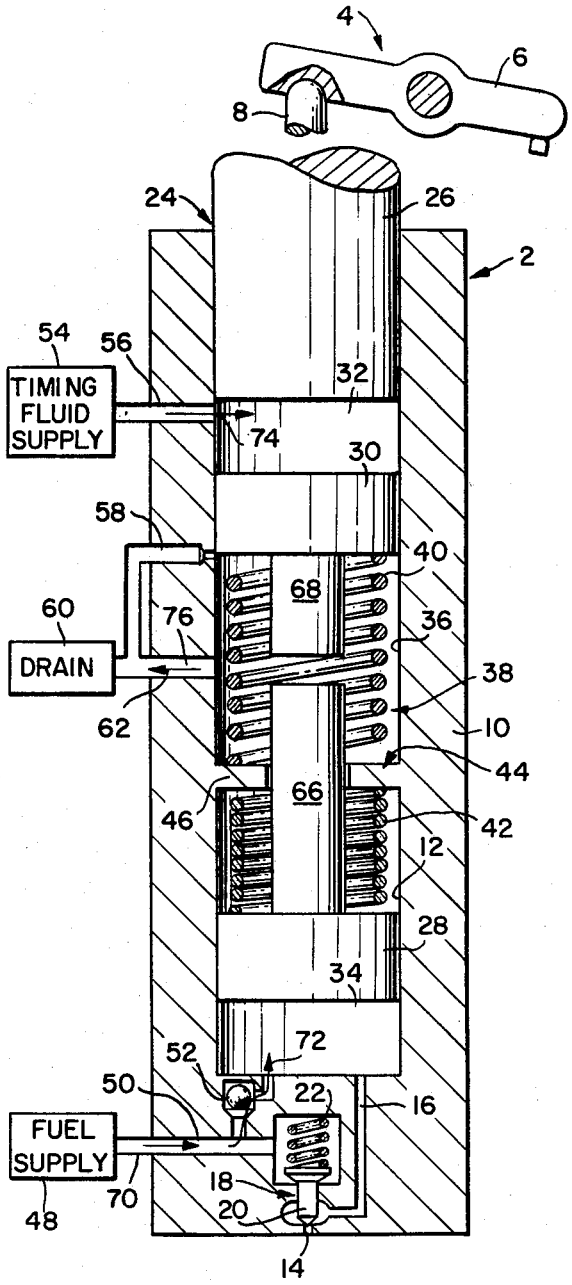
FIG. 1A is a cross sectional, schematic view of a fuel injector constructed in accordance with the subject invention including a cam actuated upper plunger section depicted in its uppermost position to allow fuel and timing fluid to flow into the injector.
Figure 1B:
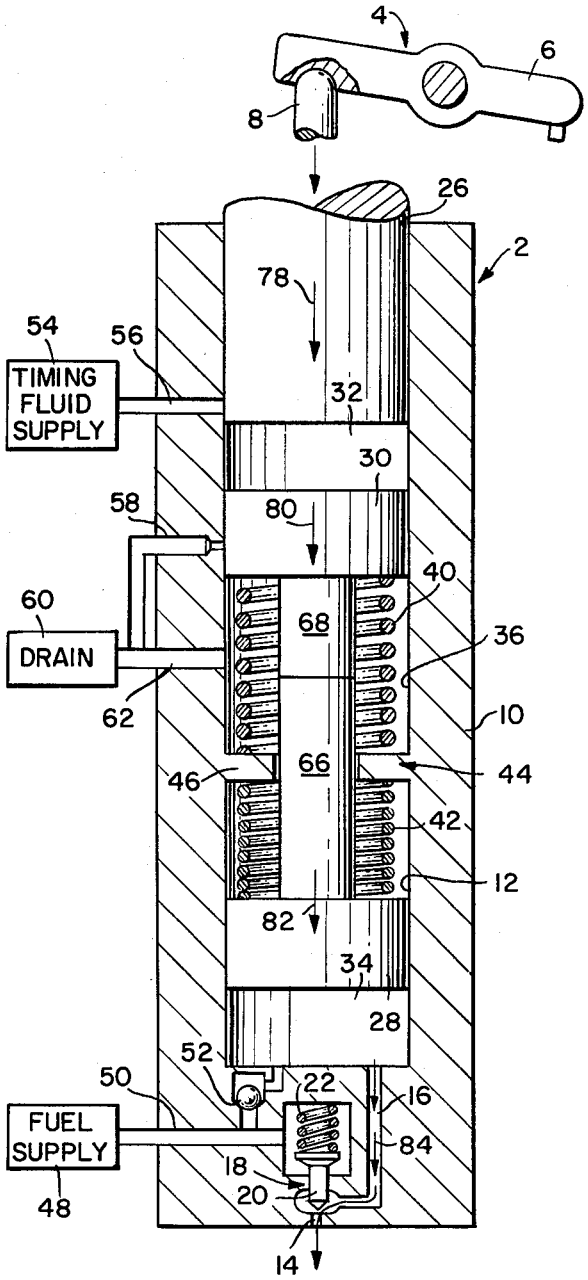
FIG. 1B is a cross sectional view of the injector illustrated in FIG. 1A wherein the upper plunger section has commenced a downward stroke to cause fuel metered into the injection chamber to be dispelled through the injector orifice.
Figure 1C:
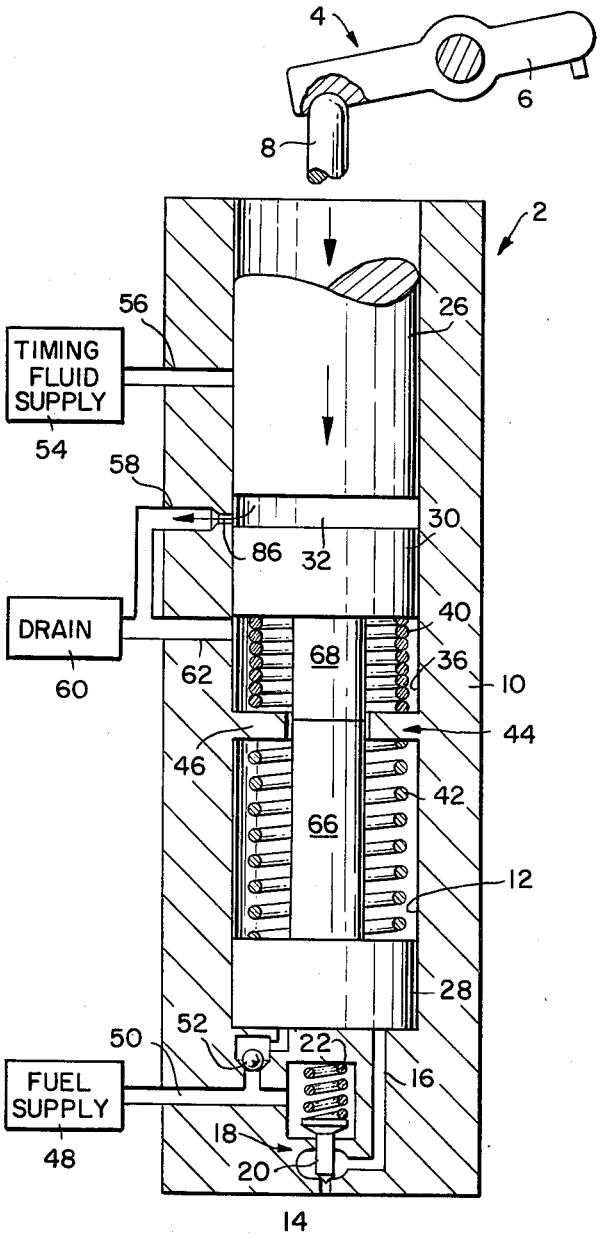
FIG. 1C is a cross sectional view of the injector illustrated in FIGS. 1A and 1B including a lower plunger section which has reached its lowermost position during the downward stroke of the upper plunger section and the timing fluid remaining in the timing chamber is being dispelled through a throttling orifice to create a strong "hold down" pressure on the lower plunger section.

For purposes of providing a clear understanding of the basic principles of this invention, reference is initially made to FIGS. 1A through 1C illustrating a highly simplified schematic diagram of a fuel injector designed in accordance with the subject invention for use in supplying fuel pulses directly into the cylinder of an internal combustion engine. In particular, FIG. 1A discloses a fuel injector assembly 2 which is mechanically actuated by a cam (not illustrated) through an actuating mechanism 4 including a rocker arm 6 and push tube 8. Because the cam is normally mounted on the conventional cam shaft (not illustrated) of the internal combustion engine, the fuel pulses produced by the injector assembly 2 may be synchronized in time with the movement of the piston within the engine cylinder.

Referring more specifically to FIG. 1A, fuel injector assembly 2 includes an injector body 10 containing a central bore 12 and an injection orifice 14 located at the lower end of the injector body 10. In this description the words "upper" and "lower" will refer to the portions of the injector assembly which are, respectively, farthest away and closest to the engine cylinder when the injector is operatively mounted on the engine. Injection orifice 14 is positioned to communicate directly on one side with the interior of the engine cylinder and on the other side to communicate with the central bore 12 through an injection passage 16. As illustrated in FIG. 1A, injection orifice 14 is normally closed by a tip valve assembly 18 including an axially slideable tip valve element 20 and a tip valve spring 22 which biases the tip valve element 20 into the position illustrated in FIG. 1A except when the pressure of fuel within passage 16 exceeds a predetermined level at which point tip valve element moves upwardly as illustrated in FIG. 1B to allow fuel to pass through injection orifice 14 into the engine cylinder. Controlling independently the amount and timing of fuel passage through orifice 14 is the purpose of the subject invention.

Mounted for reciprocal movement within central bore 12 of injector body 10 is plunger assembly 24 including an upper plunger section 26, a lower plunger section 28 and an intermediate plunger section 30. Upper plunger section 26 is mechanically biased upwardly by an injection spring (not illustrated) and is moved downwardly by push tube 8, rocker arm 6 and injector cam (not illustrated). Intermediate plunger section 30 and lower plunger section 28 are mounted for reciprocal movement independent of upper plunger section 26 in a manner to define a variable volume timing chamber 32 between the upper and intermediate plunger sections, a variable volume injection chamber 34 between the lower plunger section 28 and the lower end of injector body 10, a variable volume compensation chamber 36 between the intermediate and lower plunger sections. Located with the compensation chamber 36 is a biasing means 38 for biasing the intermediate plunger section 30 upwardly with a force which is independent of the position of the lower plunger section 28 and for biasing the lower plunger section 28 downwardly with a force which is independent of the position of the intermediate plunger section 30. Biasing means 38 includes an upper compression spring 40, a lower compression spring 42 and a retainer means 44 in the form of a radially inwardly directed ledge 46 for holding one end of each compression spring in a fixed axial position within central bore 12. Upper compression spring 40 extends between ledge 46 and intermediate plunger section 30 for tending to collapse timing chamber 32. Lower compression spring 42 extends between ledge 46 and lower plunger section 28 for tending to collapse injection chamber 34.

As further illustrated in FIG. 1A, fuel is provided to the injector assembly by a fuel supply 48 which is arranged to supply fuel to injection chamber 34 by a fuel supply passage 50 containing a check valve 52 arranged to allow fuel to flow into injection chamber 34 from fuel supply 48 but not in reverse direction. As further illustrated in FIG. 1A, timing fluid may be supplied to timing chamber 32 from a timing fluid supply 54 through a timing passage 56 which connects with the timing chamber 32 at a location adjacent the uppermost position of upper plunger section 26 as illustrated in FIG. 1A. Timing fluid is discharged from timing chamber 32 through a timing fluid drain passage 58 which connects at one end with a fluid drain 60 and at the other end with the timing chamber 32 for a limited period during each cycle of injector operation, namely the period of each cycle when the upper plunger section 26 is adjacent its lowermost position. Compensation chamber 36 also communicates with fluid drain 60 through an auxiliary passage 62. Because fluid drain 60 is maintained at a low, relatively constant pressure (e.g. less than 5 psi) compensation chamber 36, both above and below ledge 46, remains filled with fluid which flows into and out of auxiliary passage 62 as the compensation chamber 36 expands and contracts.

Ledge 46 contains a central aperture 64 through which extends an upwardly directed extension 66 of lower plunger section 28. A downwardly directed extension 68 of intermediate plunger section 30 projects toward extension 66 and comes into contact therewith during the downward stroke of upper plunger section 26 to commence the fuel injection event as will be described in greater detail below.

For an understanding of how the injector assembly 2 operates, reference will now be made to FIGS. 1A–1C, which depicts the disclosed assembly in various modes of operation. FIG. 1A shows the assembly during the period in which upper plunger section 26 is caused to dwell in its uppermost position defined by a sector of the injector actuating cam (not illustrated) which has a circumferential extent which is sufficient to provide the time necessary to allow the maximum amount of fuel to be metered into injection chamber 34 and the maximum amount of timing fluid (which may also be fuel) to be metered into the timing chamber 32. The actual amount of fuel which flows into injection chamber 34 (illustrated by arrows 70 and 72) may be controlled by varying the pressure (e.g. 10 psi to 100 psi) of fuel supplied through passage 50. If the spring rate of lower compression spring 42 is substantially linear and flow passage 50 is sufficiently large, the amount of fuel actually metered into chamber 34 will be substantially linear with respect to the pressure of fuel supplied by fuel supply 48. However, a throttling orifice may be provided in passage 50 to cause the amount of fuel actually metered to be a function of metering time as well as pressure. This type of metering (called PT metering) is known in other types of injector designs such as disclosed in U.S. Pat. No. 3,951,117. Similarly, the amount of fluid which flows into timing chamber 32 (illustrated by arrow 74) is a function of the characteristics of upper compression spring 40 and timing passage 56. If spring 40 has a linear spring rate and passage 56 is sufficiently large, the amount of fluid metered into timing chamber 32 will be a function of the pressure of fluid supplied by timing fluid 54 (e.g. 10 to 50 psi). A throttling orifice may also be placed in passage 56, to cause the amount of fluid metered to be a function of metering time as well as pressure.

As soon as the downward stroke of upper plunger section 26 has proceeded far enough to close off passage 56, the fluid metered into timing chamber 32 will form a fixed length, hydraulic link (assuming the timing fluid to be substantially incompressible) between upper and intermediate plunger sections 26 and 30.

Further downward movement of upper and intermediate plunger sections 26 and 30 will collapse compensation chamber 36, dispelling fluid through auxiliary passage 62 (see arrow 76), thereby bringing projections 66 and 68 into direct mechanical contact. This situation is illustrated in FIG. 1B wherein arrows 78, 80 and 82 show that plunger sections 26, 28 and 30 are now operating in unison as would a one piece plunger. Upon the commencement of downward movement of lower plunger section 28, check valve 52 is caused to close to shut off further fuel metering and the pressure of fuel within injection chamber 34 increases to a level sufficient to open tip valve assembly 18 to allow fuel to flow through passage 16 and orifice 14 as illustrated by arrow 84. It is apparent from a consideration of FIGS. 1A and 1B that the time during each downward stroke of upper plunger section 28 at which injection commences will be a function of the length of the hydraulic link formed in timing chamber 32 and is thus a function of timing fluid pressure. Within the limits defined by the spring rate and effective length of upper compression spring 40, the timing of injection may be infinitely varied in dependence upon changes in the timing fluid pressure.

The injection event terminates when the lower plunger section reaches the bottom of injection chamber 34 as illustrated in FIG. 1C. Without special provision, however, lower plunger section 38 might tend to bounce back upon impact with the bottom of the injection chamber resulting in an uneven cut off of fuel injection. In the past, this effect was dealt with by placing a slight compression bump on the injector actuating cam but this solution would place very high compression loads on the entire cam operated actuating mechanism and would lead to excessive wear. To eliminate the need for a compression bump, the timing fluid drain passage 58 is provided with a throttling orifice 86 which insures that a very high pressure will develop in timing chamber 32 as the fluid therein is dispelled through timing fluid drain passage 58. The throttling orifice 86 also provides an automatic compensation for wear in the actuating mechanism as further disclosed in commonly assigned U.S. patent application Ser. No. 336,308 filed Dec. 31, 1981, now U.S. Pat. No. 4,420,116 issued Dec. 13, 1983.

By providing two separate compression springs 40 and 42 in compensating chamber 36, each of which acts independently of the other, the amount of fuel metered is substantially independent of the amount of timing fluid metered during each cycle. This allows for simplified and highly predictable control over both fuel metering and timing.

Figure 2:
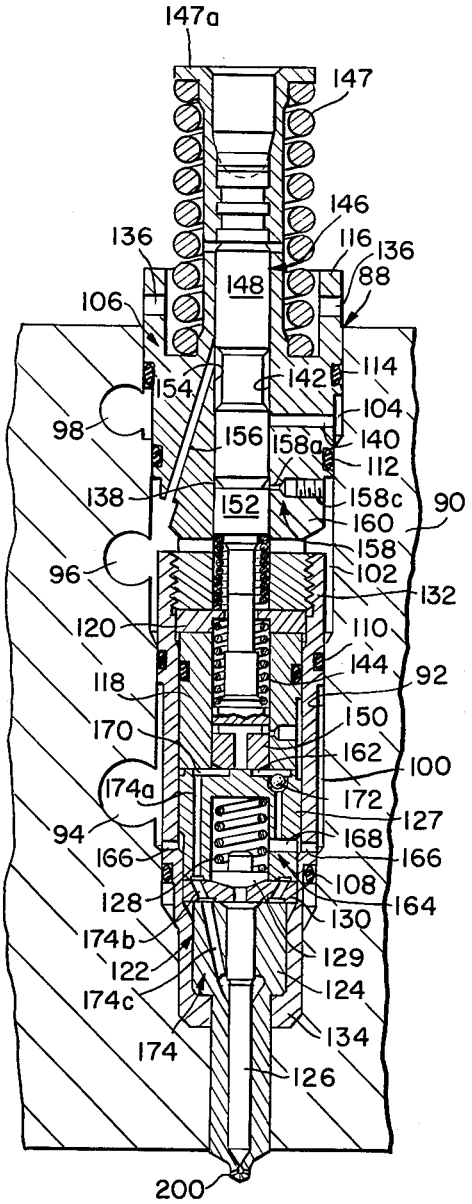
FIG. 2 is a cross sectional view of a preferred injector design incorporating the principle features of the injector as illustrated in FIGS. 1A–1C.

FIG. 2 is a cross sectional view of a more detailed practical embodiment of a fuel injector assembly 88 employing the inventive features described with reference to the schematic illustrations of FIGS. 1A–1C. Moreover, the injector assembly 88 is illuatrated in combination with a broken cross sectional view of an engine head 90 containing a recess 92 for receiving the injector assembly. Recess 92 is intersected at axially spaced locations by three internal flow paths including a fuel supply flow path (generally termed a rail) 94, a drain flow path 96 and a timing fluid flow path 98. Each of these flow paths may be formed by drilling out a single bore which intersects with each of a plurality of injector receiving recesses in a multi-cylinder engine. The various flow paths remain fluidically isolated by the provision of seal means which fluidically isolate three annular flow chambers 100, 102 and 104 of recess 92 surrounding the exterior surface of the injector body 106. In particular, the seal means includes a copper washer 108 and a second O-ring seal 110 received in corresponding annular recesses in the exterior surface of injector body 106 to define flow chamber 100 for interconnecting flow path 94 with the fuel injector assembly 88. O-ring 110 and O-ring 112 define a second annular flow path for interconnecting the drain flow path 96 and the injector assembly 88. A final O-ring 114, along with O-ring 112, define annular flow chamber 104 for interconnecting the timing fluid flow path 98 with the injector assembly 88.

Injector body 106 is formed of multiple components including an upper injector barrel 116, a lower injector barrel 118, an injector spring retainer 120, and a tip nozzle assembly 122. As illustrated in FIG. 2, tip nozzle assembly includes a tip nozzle housing 124 containing an axial bore for receiving a tip valve element 126 (corresponding to valve element 20 of FIGS. 1A–1C), a tip valve spring housing 127 containing a cavity for receiving a tip valve spring 128, a spring seat 129 connected to the upper end of tip valve element 126 and a nozzle stop 130 positioned between tip nozzle housing 124 and spring housing 126.

A cup-shaped injector assembly retainer 132 is arranged to hold the upper injector barrel 116, the injector spring retainer 120, the lower injector barrel 118, the tip valve spring housing 127, the nozzle stop 130 and the tip nozzle housing 124 in axially stacked, tight engagement. A lower, inturned radial flange 134 at the lower end of injector assembly retainer 132 engages a shoulder on the exterior of tip nozzle housing 124 and an internal thread on the inside of injector assembly retainer 132 engages an exterior thread on the lower portion of upper injector barrel 116 to allow the entire assembly to be held in tight engagement. The injector assembly 88 is normally held in position by a clamp (not illustrated) and may be removed by a tool designed to engage radial holes 136 located in the section of upper injector barrel 116 which extends above the upper surface of head 90.

Timing fluid under variable control pressure from flow path 98 is transferred to the timing chamber 138 (shown in a collapsed condition in FIG. 2) through a radial timing passage 140 formed in upper injector barrel 116 between annular flow chamber 104 and the upper central bore section 142 contained in upper injector barrel 116. Lower injector barrel 118 contains a lower central bore section 144 aligned with upper section 142.

A plunger assembly 146, received in upper and lower central bore sections 142 and 144, includes an upper plunger section 148, a lower plunger section 150 and an intermediate plunger section 152 corresponding to elements 26, 28 and 30, respectively of FIGS. 1A–1C. In addition, plunger assembly 146 includes a plunger spring 147 connected with upper plunger section 148 by a plunger spring retainer **147*a* for biasing the upper plunger section 148 in an upward direction. Upper plunger section 148 contains an annular recess 154 positioned above timing passage 140 to receive all timing fluid and fuel which may leak upwardly between the plunger assembly 146 and injector body 106. A leakage passage 156 extends axially and radially downwardly from a position opening into upper central bore section 142 adjacent recess 154 into annular flow chamber 102. A timing fluid drain passage 158 (corresponding to timing fluid drain passage 58 of FIGS. 1A–1C) contained in upper injector barrel 116 is formed by a radial passage 158*a* containing a throttling orifice 158*b* at one end and a threaded plug 158*c* at the other end. Timing fluid drain passage 158 further includes a downwardly angled discharge branch 160 which connects with annular flow chamber 102**.

Fuel enters the injection chamber 162 (illustrated in collapsed condition in FIG. 2) through a fuel supply passage 164 including a pair of opposed radial passages 166 contained in injector assembly retainer 132. From radial passages 166, fuel passes into a radial passage 168 and axial passage 170 contained in tip valve spring housing 127 opening in a circular groove 170 on the top surface of tip valve spring housing 127. Radial passage 168 also supplies fuel under supply pressure to the interior of spring housing 127 to apply fuel supply pressure to valve element 126. Fuel enters injection chamber 162 through a check valve 172 located at the top of axial passage 168 and is discharged through an injection passage 174 formed of branches **174*a*, 174*b*, 174*c* contained in spring housing 127, nozzle stop 130 and tip nozzle housing 124**, respectively.

Figure 3B:
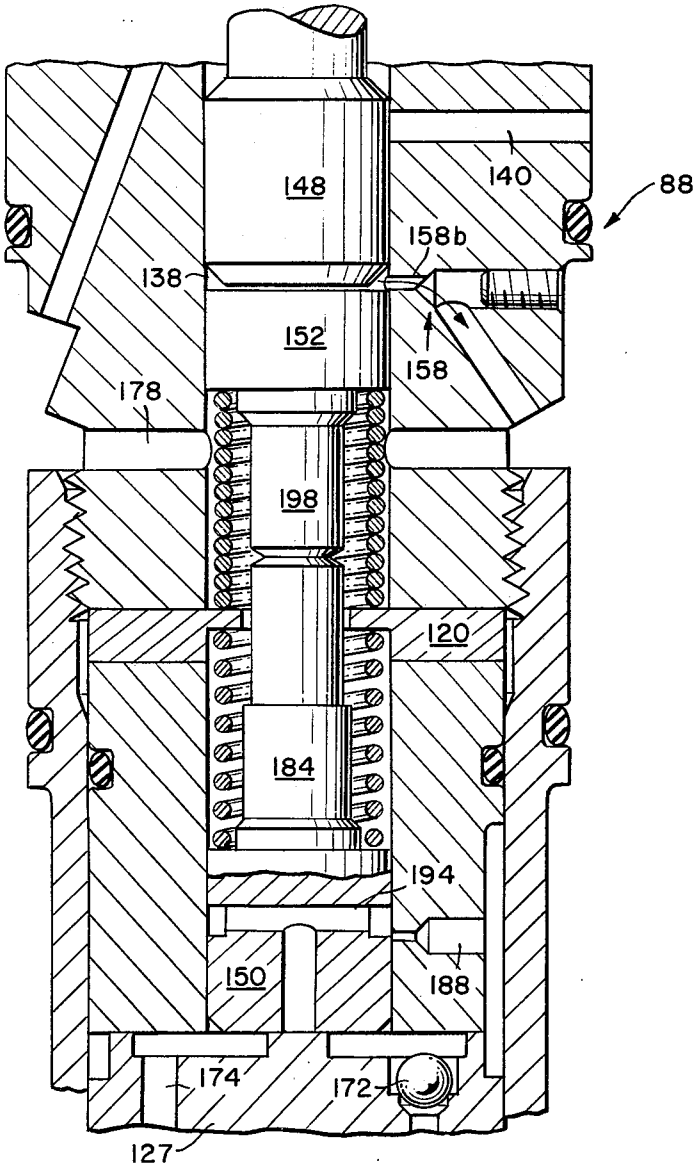
FIG. 3B is a broken away cross sectional view of the injector illustrated in FIG. 2 wherein the injector plunger sections have reached their lowermost position following an injection event.
Figure 3A:
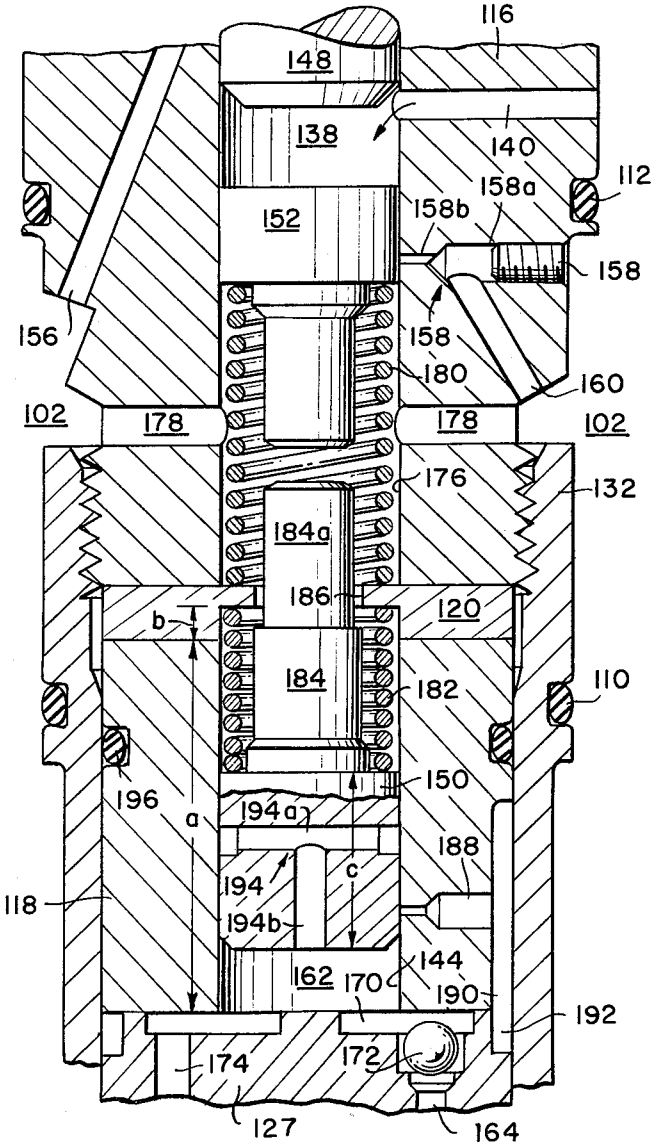
FIG. 3A is a broken away cross sectional view of the injector illustrated in FIG. 2 wherein both timing fluid and fuel are being metered into the injection chamber and timing chamber, respectively.
Figure 4:
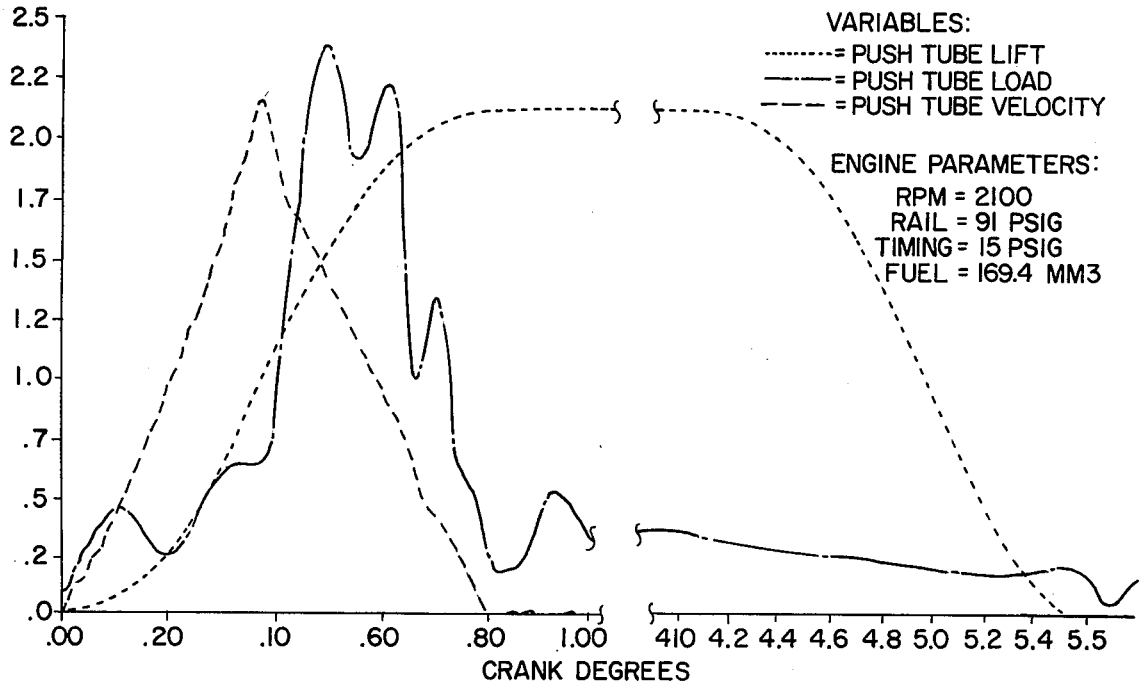
FIG. 4 is a graph illustrating the push tube lift, load and velocity plotted against crankshaft position for an engine equipped with an injector design in accordance with the subject invention.

For a clearer understanding of the structure and function of the injector embodiment of FIG. 2, reference is now made to FIG. 3A which is a broken away, enlarged, cross-sectional view of the central section of the injector assembly 88. FIG. 3A shows the condition of the compensation chamber 176 formed between intermediate plunger section 152 and lower plunger section 150. Compensation chamber 176 is kept filled with fuel from annular flow chamber 102 through radial auxiliary passages 178 because the engine drain flowpath is maintained at a constant low pressure. The upper and lower compression springs 180 and 182 are arranged in the same manner as upper and lower compression springs 40 and 42 illustrated in FIGS. 1A–1C. These springs are carefully chosen and the dimensions of compensation chamber 176 are carefully controlled to produce a known and predictable response to pressure variations supplied to the timing chamber 138 and injection chamber 162. For example, experiments have shown that predictable results are obtained if the length of lower compression spring 182 is held to ±0.001 inches and the spring rate is held to ±2%. Dimension a of the lower injection barrel 118 should be held to ±0.001 inches, dimension b of the injection spring retainer should be held to ±0.001 inches and dimension c of the lower plunger section 150 should also be held to ±0.0015 inches. If shims are used, a lower cost spring may be substituted having a spring length of ±0.005 inches and a spring rate of ±0.6%. It should be further noted that lower plunger section 150 includes an upwardly directed extension 184 having a reduced diameter portion **184*a* which passes through an aperture 186 contained in injection spring retainer 120. A sufficient radial space exists between portion 184*a* and aperture 186 to allow fuel to pass readily back and forth between the portions of compensation chamber 176 located above and below injector spring retainer 120. The lower portion of upwardly directed extension 184 has a diameter which is larger than the diameter of aperture 186 to form thereby a stop for lower plunger section 150 which defines the maximum volume of injection chamber 162**.

FIG. 3A also discloses that lower injector barrel 118 contains a fuel drain passage extending between lower central bore section 144 and an axial groove 190 extending toward a peripheral groove 192 on the top surface of spring housing 127. As lower plunger section 150 nears its lowermost position, a fuel drain passage extension 194, including a radial portion **194*a* and an axial portion 194*b*, form a path of communication between injection chamber 162 and fuel drain passage 188. The purpose of the fuel drain passage 188 is to quickly reduce the pressure within injection chamber 162 to produce a positive and predictable end to the injection event. This also reduces the requirement for a large "hold down" force to be created by fluid in the timing chamber, thus reducing the camshaft loading. However, to prevent excessive impact velocity of lower plunger section 150 with the upper surface of spring housing 127, a throttling orifice 188*a* is formed in fuel drain passage 188. While the fuel discharged from the injection chamber 162 through fuel drain passage 188 may be returned to the engine drain flowpath through annular flowpath 102, the preferred approach is to direct the discharged fuel from passage 188 and groove 190 back to the fuel supply passage by providing a seal 196 between the lower injection barrel 118 and the injector assembly retainer 132 and by providing a small clearance between the exterior of spring housing 127 and the interior of injector assembly retainer 132**.

In order to describe the function of injector assembly 88, reference will now be made to FIGS. 2, 3A and 3B. In particular, FIG. 3A discloses a period during injector operation in which timing fluid flows into timing chamber 138 to cause intermediate plunger section 152 to move in a downward direction for a distance which is proportional to the pressure of the timing fluid. Similarly, fuel is being metered through fuel supply passage 164 past check valve 172 into injection chamber 162. Again, the amount of fuel actually metered into chamber 162 will depend upon the pressure of fuel supplied through fuel supply passage 164.

Referring now to FIG. 3B, the injector assembly 88 is now shown in a condition achieved at the end of the injection event wherein upper injector plunger 148 has completed its downward stroke during which timing fluid passage 140 was closed to form a hydraulic link between the upper plunger section and intermediate plunger section 152. As the downward stroke continued, the downwardly directed extension 198 of intermediate plunger section 152 came in contact with the upwardly directed extension 184 of the lower plunger section 150 to cause the injection event to commence. As the downward stroke of upper injector section 148 continued, substantially all of the fuel metered into injection chamber 162 was discharged through the injection passage 174 and out of injection orifice 200 (FIG. 2). At the moment, the fuel drain passage extension 194 came into registry with the fuel drain passage 188, the pressure within injection chamber 162 was relieved to quickly terminate injection. The small amount of fuel discharged through fuel drain extension 194 and 188 was recirculated back to the fuel supply passage 164. Final downward movement of the lower injector plunger ceased upon contact of the lower injector plunger with the upper surface of the spring housing 127.

In order to hold lower injector plunger 150 in its lowermost position as illustrated in FIG. 3B, the timing fluid discharge passage 158 is located to be opened just before lower injector plunger 150 reaches its lowermost position. Accordingly, the timing fluid which has been metered into timing chamber 138, will be discharged through throttling orifice **158*b*. The size of orifice 158*b* is chosen so as to produce a substantial hold down pressure throughout the remainder of the downward movement of the upper plunger section 148**. This technique for insuring adequate hold down pressure also provides an automatic wear compensation feature since the dimensions of the plunger sections and the location of the timing fluid discharge passage is chosen so as to insure that some timing fluid is discharged during each injection cycle. Thus, even in the retard mode of injector operation, at least some timing fluid is metered into the timing chamber in order to produce the hydraulic hold down pressure described above.

The graphs depicted in FIGS. 4–7 disclose the results of experimental tests conducted on actual injector models built in accordance with the features described above. In particular, FIG. 4 discloses three separate graphs of the operation of a model injector of the type illustrated in FIGS. 2, 3A and 3B including the throttled discharge of timing fluid as well as a spill-type discharge of metered fuel from the injection chamber by an arrangement of fluid discharge passages. In particular, the push tube velocity shows a steady rise and drop off of push tube velocity whereas the push tube load similarly discloses a relatively early drop off under the engine parameters indicated in FIG. 4.

Figure 5:
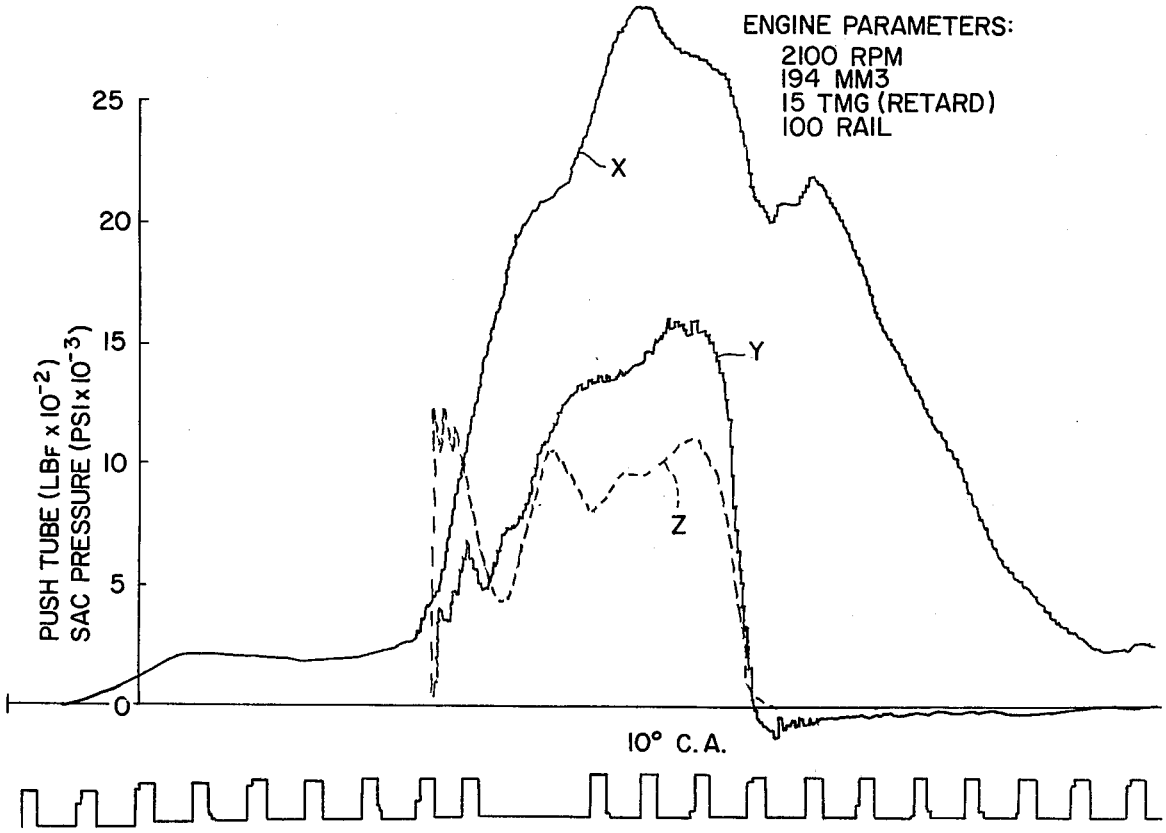
FIG. 5 is a graph of the push tube load and injection chamber sac pressure in an injector system designed in accordance with the subject invention as compared with a more conventional injector system.

FIG. 5 discloses a graph of the push tube load (curve x) and sac pressure (curve y) for a fuel injector of the type illustrated in FIGS. 2, 3A and 3B when installed in a test rig operating under the indicated conditions. Sac pressure is the pressure of the fuel in the chamber just in front of the injector spray holes—200. For comparison purposes, the sac pressure of a more conventional injector design is shown by curve z in FIG. 5. By comparison of curve z with curve y, it is apparent that the sac pressure achieved by an injector designed in accordance with the subject invention will have a higher pressure during injection and a sharper cut-off than was achieved by the conventional injector which was a commercially available injector identified as a PTD injector manufactured by the Cummins Engine Company, assignee of the subject invention.

For comparison purposes, FIG. 6 is a graph of the same injector characteristics as illustrated in FIG. 5 except that the fuel supply pressure and the timing fluid pressure have been changed as indicated from the retarded timing condition shown in FIG. 5 to the advanced timing condition illustrated in FIG. 6. Again, however, sac pressure of the injector designed in accordance with the subject invention (illustrated by curve y') is higher and drops off more rapidly than does the sac pressure of a conventional Cummins PTD injector whose performance is illustrated by curve z'.

FIG. 7 is a graph showing the substantial linearity of the start and end of injection as the timing pressure is varied from 15 to 70 psi. when installed in a test rig operating under the indicated conditions.

INDUSTRIAL APPLICABILITY

The fuel injector design described above is able to achieve accurate and independent control over fuel metering and injection timing by means of a relatively simple and easily manufactured injector. Such injectors would be usable on a broad range of internal combustion engines, especially of the compression ignition type. A particularly appropriate application of the subject injector design would be for a small compression ignition engine suitable for trucks, automobiles, other types of vehicles and stationary power plant applications.

We claim:

1. A fuel injector for periodically injecting fuel of a variable quantity on a cycle to cycle basis as a function of the pressure of fuel supplied to the injector from a source of fuel and at a variable time during each cycle as a function of the pressure of a timing fluid supplied to the injector from a source of timing fluid, comprising (a) an injector body containing a central bore and an injector orifice at the lower end of the body;

(b) a reciprocating plunger assembly including an upper plunger section, an intermediate plunger section and a lower plunger section serially mounted within said central bore to define (1) a variable volume injection chamber located between said lower plunger section and the lower end of said injector body containing said injection orifice, said variable volume injection chamber communicating during a portion of each injector cycle with the source of fuel, (2) a variable volume timing chamber located between said upper and intermediate plunger sections, said timing chamber communicating for a portion of each injector cycle with the source of timing fluid, and (3) a variable volume compensation chamber located between said intermediate and lower plunger sections; and (c) biasing means located within said variable volume compensating chamber for biasing said intermediate and lower plunger sections in opposite directions to collapse said timing and injection chamber, respectively, while tending to expand said compensating chambers.

2. A fuel injector as defined by claim 1 for injecting fuel into a cylinder of an internal combustion engine having a piston reciprocating within the cylinder and a cam-operated injector actuating mechanism reciprocally moving in a predetermined phase relationship with the reciprocating piston, wherein said upper plunger section is adapted to be reciprocated by the cam-operated injector actuating mechanism to cause said upper plunger section to reciprocate in a fixed phase relationship with the reciprocating piston in the cylinder into which fuel is being injected.

3. A fuel injector as defined by claim 2, wherein said injector body contains a timing fluid supply passage communicating at one end with the source of timing fluid and communicating at the other end with said timing chamber only when said upper plunger section is adjacent its uppermost position within said central bore.

4. A fuel injector as defined by claim 3 for use with an internal combustion engine containing a fluid drain, wherein said injector body contains a timing fluid drain passage communicating at one end with the fluid drain and communicating at the other end with said timing chamber only when said upper plunger section is adjacent is lowermost position within said central bore.

5. A fuel injector as defined by claim 3, wherein said injector body contains a fuel supply passage communicating at one end with the fuel supply and communicating at the other end with said injection chamber.

6. A fuel injector as defined by claim 5 for use with an internal combustion engine containing a fluid drain, wherein said injector body contains a fuel drain passage communicating at one end with the fluid drain and at the other end with said injection chamber only when said lower plunger section is adjacent its lowermost position within said central bore.

7. A fuel injector as defined by claim 6, wherein said lower plunger section contains a fuel drain passage extension communicating at one end with said injection chamber and at the other end with said fuel drain passage only when said lower plunger section is adjacent its lowermost position within said central bore.

8. A fuel injector as defined by claim 6, wherein said fuel drain passage extension includes a radial portion and an axial portion which is closed when said lower plunger section reaches its lowermost position.

9. A fuel injector as defined by claims 1, 2, 4 or 6, wherein said biasing means includes an upper compression spring, a lower compression spring and a retainer means for holding one end of each said compression springs in a fixed axial position within said central bore, said retainer means including a retainer ledge which extends radially inwardly into said central bore for engaging one end of each of said compression springs, said upper and lower compression springs extend, respectively, between said retainer ledge and said intermediate plunger section and said lower plunger section.

10. A fuel injector as defined in claim 9, wherein said ledge contains a central aperture and said intermediate plunger section includes a downwardly directed extension, said lower plunger section includes an upwardly directed extension and at least one of said extensions is shaped to pass through said central aperture in said ledge and said extensions have an axial extent which causes said extensions to come into direct contact during each downward stroke of said upper plunger section.

11. A fuel injector as defined in claim 10, wherein said injector body includes an upper barrel, a lower barrel spaced from said upper barrel by said spring retainer, a nozzle assembly container and injection orifice and an assembly retainer means for connecting said upper barrel, said lower barrel and said nozzle means into a single unit.

12. A fuel injector as defined in claim 11, wherein said nozzle means includes a tip valve movable between an open position in which said injection orifice is open and a closed position in which said injection orifice is closed and a nozzle spring for biasing said tip valve toward said closed position but permitting said tip valve to move to said open position whenever the fuel pressure within said injection chamber reaches a predetermined level.

13. A fuel injector as defined in claim 12, wherein said upper barrel contains a leakage passage communicating at one end with the upper portion of said central bore above said timing chamber and at the other end with the drain, and wherein said upper plunger section includes an annular recess for collecting fuel and timing fluid which leaks upwardly in said central bore above said timing chamber, said annular recess being axially positioned to communicate at all times with said leakage passage to permit the leaked fuel and timing fluid to be directed into said leakage passage.

14. A periodic fuel injector, comprising (a) an injector body containing a central bore and an injection orifice at the lower end of the body;

(b) metering means for metering a variable quantity of fuel for injection through said injection orifice on a periodic basis dependent upon the pressure of fuel supplied to said injector body, said metering means including a lower plunger section mounted for reciprocal movement within said central bore;

(c) hydraulic timing means for varying the timing of each periodic injection of metered fuel dependent upon the pressure of a hydraulic timing fluid supplied to said injector body, said hydraulic timing means including an upper plunger section mounted for reciprocal movement within said central bore and an intermediate plunger section mounted for reciprocal movement within said central bore between said upper and lower plunger sections; and (d) biasing means mounted between said intermediate plunger section and said lower plunger section for biasing said intermediate plunger section upwardly with a force which is independent of the position of said lower plunger section and for biasing said lower plunger section downwardly with a force which is independent of the position of said intermediate plunger section.

* * * * *

UNITED STATES PATENT AND TRADEMARK OFFICE

CERTIFICATE OF CORRECTION

PATENT NO. : 4,463,901

DATED : August 7, 1984

INVENTOR(S) : Julius P. Perr and Lester L. Peters

It is certified that error appears in the above-identified patent and that said Letters Patent are hereby corrected as shown below:

In column 12, line 12 "chambers" should read --chamber--.

Signed and Sealed this

*Thirtieth* Day of *July 1985*

[SEAL]

*Attest:*

DONALD J. QUIGG

*Attesting Officer* *Acting Commissioner of Patents and Trademarks*